United States Patent [19]

Wosika et al.

[11] 4,167,097

[45] Sep. 11, 1979

[54] GAS TURBINE ENGINES WITH IMPROVED COMPRESSOR-COMBUSTOR INTERFACES

[75] Inventors: Leon R. Wosika; John G. Vawter, both of San Diego, Calif.

[73] Assignee: International Harvester Company, Chicago, Ill.

[21] Appl. No.: 831,970

[22] Filed: Sep. 9, 1977

[51] Int. Cl.[2] ..... F02C 3/04

[52] U.S. Cl. ..... 60/39.31; 60/39.36; 415/207

[58] Field of Search ..... 60/39.31, 39.32, 39.36, 60/39.37, 39.51 R; 415/115, 207, 211, 219 R, 116

[56] References Cited

U.S. PATENT DOCUMENTS

| | | | |
|---|---|---|---|
| 2,780,060 | 2/1957 | Griffith | 60/39.36 |
| 3,388,888 | 6/1968 | Kercher et al. | 415/115 |
| 3,826,084 | 7/1974 | Branstrom et al. | 60/39.31 |
| 3,904,312 | 9/1975 | Exley | 415/207 |

*Primary Examiner*—Louis J. Casaregola

*Attorney, Agent, or Firm*—Strauch, Nolan, Neale, Nies & Kurz

[57] ABSTRACT

Gas turbine engines with interfaces between a compressor and a combustor which minimize disturbances in the pattern of air flowing from the compressor to the combustor. Provision is also made for dissipating disturbances which may have been created and for supplying compressor discharge air to the turbine of the engine to cool specified turbine components.

4 Claims, 3 Drawing Figures

GAS TURBINE ENGINES WITH IMPROVED COMPRESSOR-COMBUSTOR INTERFACES

Figure 1A:
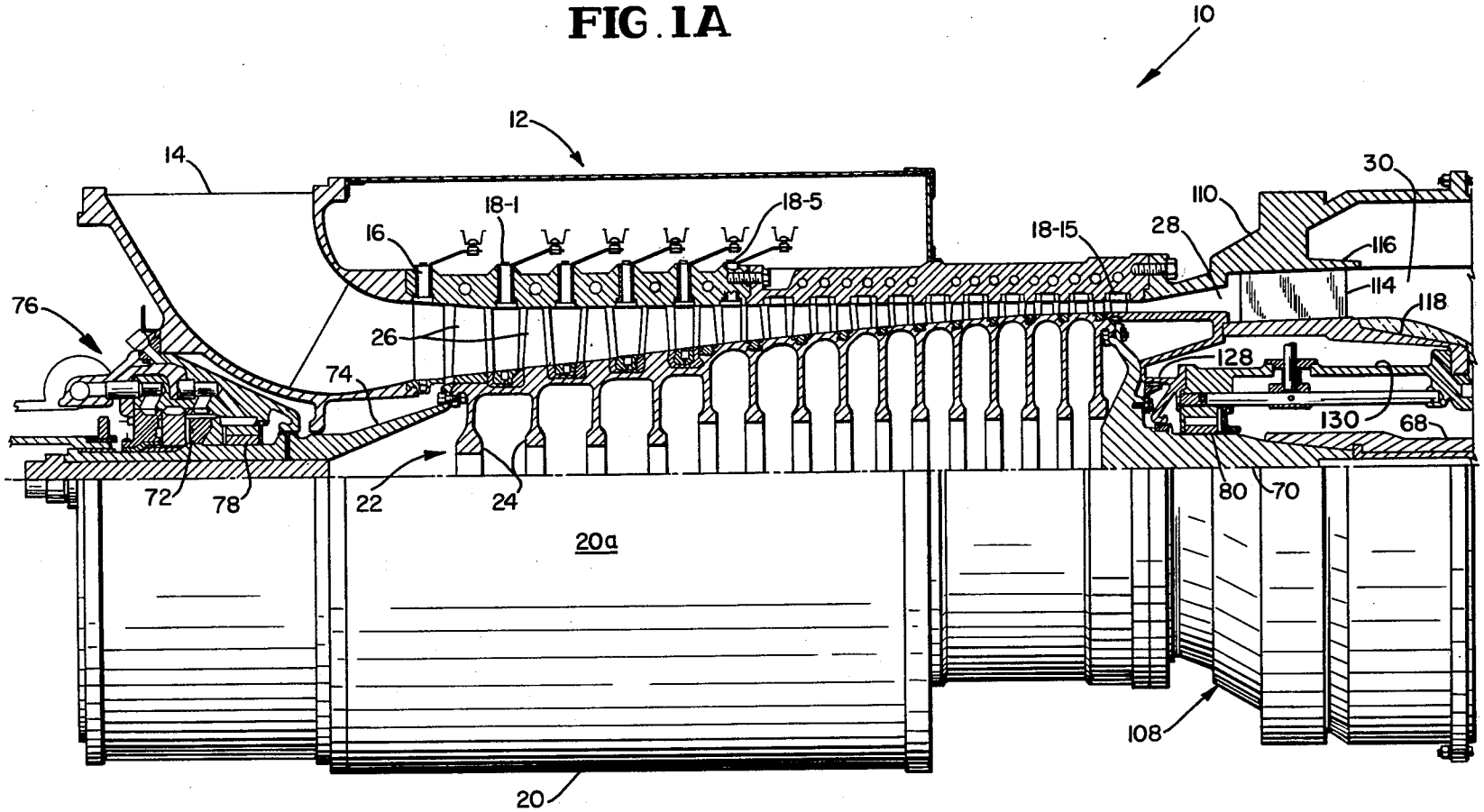

The present invention relates to gas turbine engines and, more particularly, to gas turbine engines having a compressor, a combustor, and a novel interface between the discharge end of the compressor and the combustor for promoting uniformity in the flow pattern of the air reaching the combustor.

It is conventional in gas turbine engine design to discharge air from an axial flow compressor into a diverging diffuser communicating with the discharge side of the compressor. This decelerates the air and, in part, converts the velocity head of the air into a static head. In a conventional turbine engine the air is then directed in as short a longitudinal span as possible to a combustor, which may protrude well into the diffuser itself. The hot gases are thereafter typically expanded through a gas producer turbine which drives the compressor and then through a power turbine to produce useful rotation shaft output energy.

Another feature of one conventional design is the location of radial struts in the diffuser passage. These are employed to support the compressor shaft and/or other engine components.

Turbine engines featuring the conventional compressor-combustor interface just described are shown in U.S. Pat. Nos. 2,498,728 issued Feb. 28, 1950, to Way; 2,702,985 issued Mar. 1, 1955, to Howell; 2,711,074 issued July 21, 1955, to Howard; 2,756,561 issued July 31, 1956, to Morley; 2,743,579 issued May 1, 1956, to Gaubatz; 3,026,675 issued Mar. 27, 1962, to Vesper et al; 3,300,121 issued Jan. 24, 1967, to Johnson; and 3,750,397 issued Aug. 7, 1973, to Cohen et al.

An important disadvantage of the conventional arrangements, especially those with struts located in a diffuser where flow velocities may still be relatively high, is that disturbances are introduced into the air discharged from the compressor into the diffuser. And, because of the short distances between the struts and the combustor, there is little, if any, opportunity for flow disturbances to even out or dissipate before the air reaches the combustor. These flow disturbances cause non-uniformity in the distribution pattern of the air reaching the combustor which is undesirable because non-uniformity can cause flame streaking and otherwise produce a lack of uniformity in the temperature profile of the gases supplied to the first turbine stage. This results in a degradation in efficiency and/or localized overheating which causes rapid deterioration of the overheated components.

The disadvantages of the conventional arrangement just described are minimized, if not entirely eliminated, by the novel compressor-combustor interface of the present invention. In general, this novel interface includes a diverging diffuser as in the conventional arrangement. However, in contrast to the latter, there are no struts in the diffuser; and the air does not exit directly from the diffuser to a combustor but is instead dumped into a large volume plenum, further reducing the flow velocity of the air.

Such radial struts as may be needed to support internal engine combustion are located in the plenum rather than in the diffuser as in the conventional arrangement. Because of the lower flow velocity in the environment in which they are located, the struts in the interface of the present invention cause less disturbance in the air flowing across them. Further minimization of disturbances in the air flow pattern is effected by employing struts with airfoil sections and by orienting those struts with their leading edges facing upstream; i.e., toward the discharge side of the compressor.

A substantial added increase in the uniformity of the air flow is achieved by extending the plenum into which the air is dumped from the diffuser over a substantial distance between the trailing edges of the struts and the combustor. As the air flows through this part of the plenum at the low velocity existing therein, such variations in the flow pattern as may have been introduced by the struts or otherwise tend to even out, minimizing variations in the flow of air to the combustor.

The net result of the novel compressor-combustor interface features discussed above is minimization of hot streaks and similar unwanted variations in the temperature of the gases supplied to the first stage turbine nozzles with a consequent minimization of localized overheating and improved thermal efficiency.

Yet another advantage of the novel interface disclosed herein is that the plenum into which the compressor discharge air is dumped constitutes a convenient source from which compressor air may be bled to the turbine of the engine to cool components of the latter.

From the foregoing it will be apparent to the reader that one important and primary object of the present invention resides in the provision of novel, improved compressor-combustor interfaces for gas turbine engines.

A related, but more specific, object of the invention resides in the provision of gas turbine compressor-combustor interfaces which are capable of minimizing variations in the flow pattern of the compressor discharge air supplied to the combustor, thereby minimizing temperature variations and localized overheating while promoting thermal efficiency.

Other also related and important but still more specific objects of the invention reside in the provision of compressor-combustor interfaces:

which have diverging diffusers that are free of the conventional radial struts and of the flow disturbances resulting from diffuser-housed struts;

which have large volume plenums into which compressor discharge air is dumped from a diverging diffuser to further reduce its velocity and in which such supporting struts as may be necessary are housed in said plenum to minimize the flow pattern disturbances caused by the struts;

in which, in conjunction with the preceding object, there is an expanse of the plenum between the trailing edges of the struts and the combustor for dissipating disturbances in the air flowing therethrough;

which have a plenum capable of supplying compressor discharge air to the turbine of a gas turbine engine to cool components of the latter.

Figure 1B:
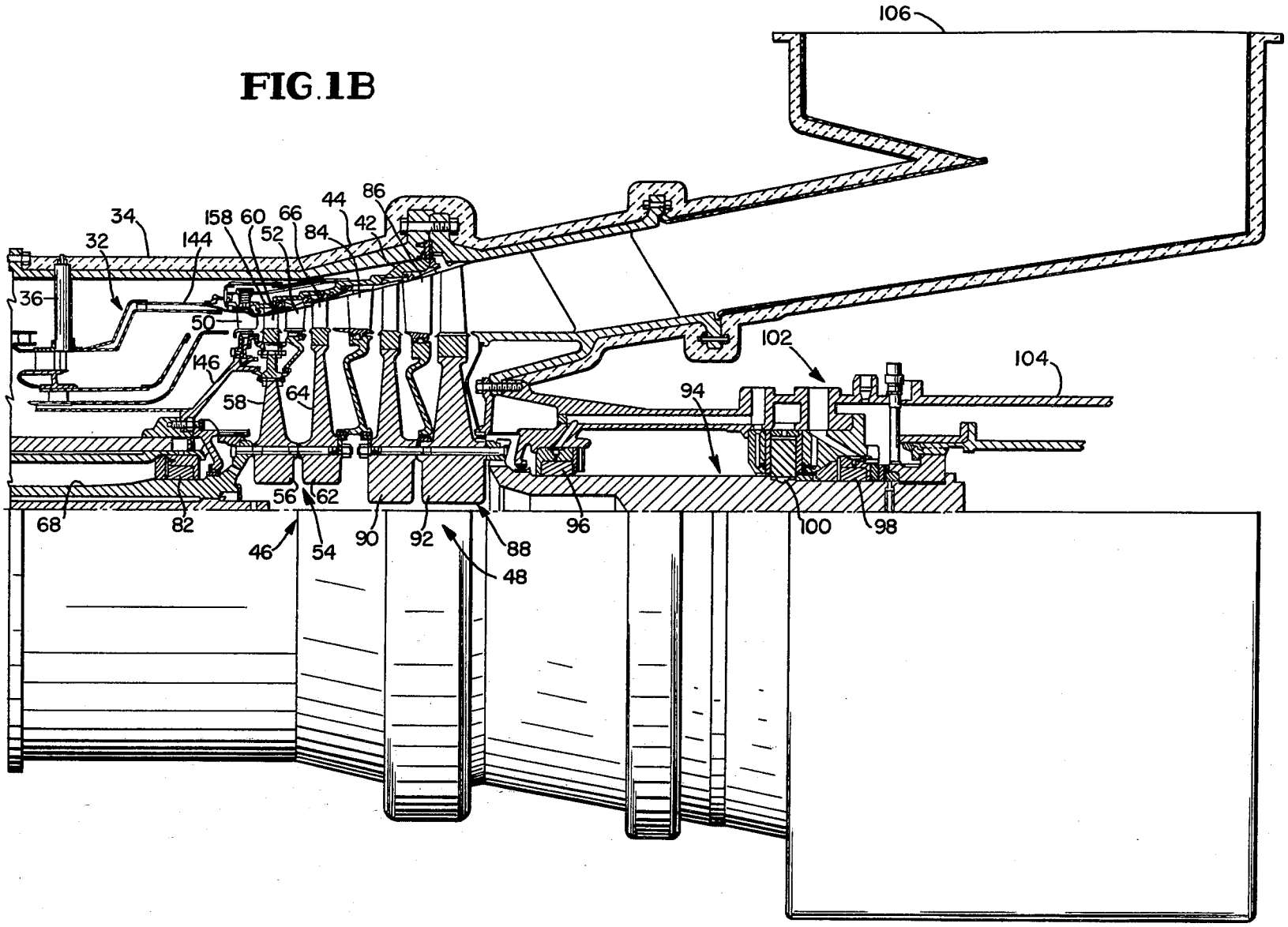
Figure 2:
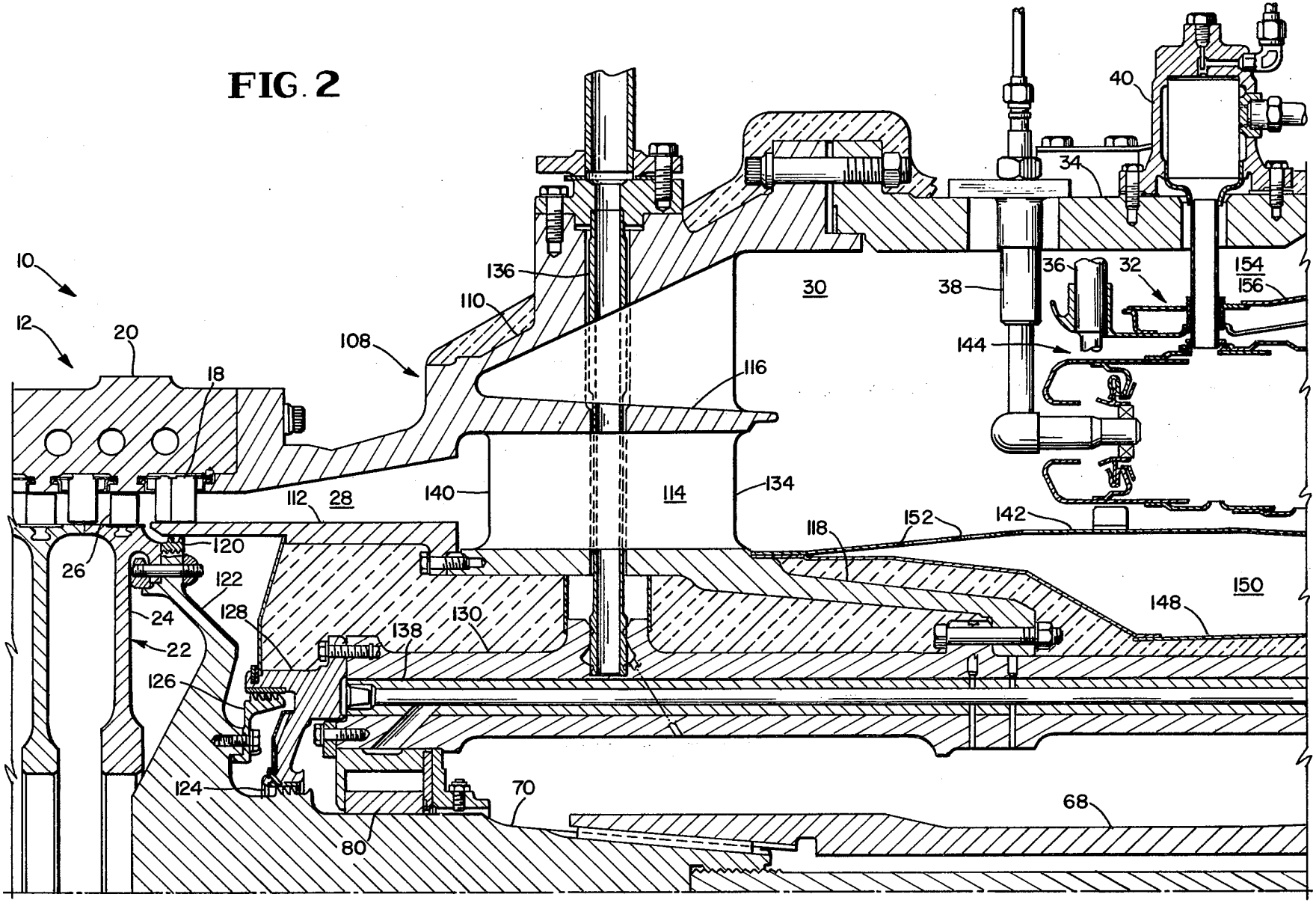

Other important objects and features and additional advantages of the invention will become apparent from the appended claims and as the ensuring detailed description and discussion proceeds in conjunction with the accompanying drawing, in which:

FIGS. 1A and 1B, taken together, constitute a partially sectioned side view of a gas turbine engine having a compressor-combustor interface embodying and constructed in accord with the principles of the present invention; and FIG. 2 is a fragment of the foregoing view drawn to an enlarged scale to show the interface in more detail.

Referring now to the drawing, FIGS. 1A, 1B and 2 depict a two-shaft, gas turbine engine 10 which has a compressor-combustor interface in accord with the principles of the present invention.

Engine 10 includes a fifteen-stage axial flow compressor 12 with a radial-axial inlet 14. Inlet guide vanes 16 and stators 18 of the compressor are supported from compressor housing 20 with the guide vanes and the stators 18-1 through 18-5 of the first five stages being pivotally mounted so that they can be adjusted to control the flow of air through the compressor.

The fifteen-stage rotor 22 of compressor 12 is composed of discs 24 with vanes 26 fixed thereto. The discs are joined as by electron beam welding into a single unit.

Compressor housing 20 is split longitudinally on a vertical plane through the axial certerline of the housing into two sections 20*a* (only one of which is shown). This accomodates installation of the compressor rotor and facilitates access to the rotor blades, guide vanes, and stators for inspection, cleaning, and replacement.

The high pressure air discharged from compressor 12 flows through an annular, diverging diffuser 28 into an enlarged plenum 30 and from the latter to an annular combustor 32 supported for relative movement from an insulated combustor case or housing 34 by radially extending liner pins 36 (see FIG. 2).

Fuel is supplied to combustor 32 through injectors 38 and ignited by a conventional igniter 40.

The compressor discharge air heated by combustor 32 and the combustion products are discharged into a nozzle case 42 supported in an annular turbine housing 44. The heated air and combustion products are expanded first through a two-stage gas producer turbine 46 and then through a two-stage power turbine 48.

Gas producer turbine 46 has internally cooled, first and second stage nozzles 50 and 52 and a two-stage rotor 54.

The first stage 56 of gas producer turbine rotor 54 includes a disc 58 to which internally cooled, radially extending blades 60 are fixed. The second stage 62 includes a disc 64 with uncooled, radially extending blades 66 mounted on its periphery.

The two stages of gas producer turbine rotor 54 are bolted to each other and, in cantilever fashion, to the rear end of a forwardly extending shaft 68. Shaft 68 is keyed to rear compressor hub 70 which is bolted to compressor rotor 22, thereby drive-connecting gas producer turbine 46 to the compressor rotor.

The compressor rotor and gas producer turbine are rotatably supported by a thrust bearing 72 engaged with a front compressor hub 74 drive-connected to an accessory drive 76 and by tapered land bearings 78, 80, and 82.

Power turbine 48 includes first and second stage nozzles 84 and 86 also supported from nozzle case 42 and a rotor 88 having a first bladed stage 90 and a second, bladed stage 92 bolted together for concomitant rotation. Neither the nozzles nor the rotor are cooled.

Rotor 88 is bolted to a shaft assembly 94 rotatably supported by tapered land bearings 96 and 98 and by a thrust bearing 100. The shaft assembly is connected through a coupling 102 to an output shaft assembly 104 which is the input for a generator, booster compressor, mechanical drive, or other driven unit.

The final major component of turbine engine 10 is an exhaust duct 106 for the gases discharged from the power turbine.

For the most part, the details of the gas turbine engine components discussed above are not relevant to the practice of the present invention. Therefore, they will be described only as necessary to provide a setting for and facilitate an understanding of the latter.

Referring now primarily to FIG. 2, a diffuser housing assembly 108 having an annular, integral, diverging housing component 110 is bolted between compressor housing 20 and combustor case 34. Component 110 defines the diverging outer boundary of diffuser 28.

The inner boundary of the diffuser is defined by an annular shroud 112.

In addition to component 110 diffuser housing assembly 108 includes integral, radial struts 114; an annular intermediate wall 116, which defines the outer boundary of the forward or upstream end of plenum 30; and an inner, annular bracket 118 which is integral with struts 114 at the inner ends thereof.

Annular shroud 112 is bolted to the forward end of diffuser housing assembly inner support 118 and extends therefrom toward compressor 12 and into sealing engagement with a peripheral labyrinth seal 120 on an annular flange 122 at the forward end of compressor rear hub 70. The outer surface at the forward end of the shroud is abutted by the inner ends of the stators 18 in the last stage of the compressor.

Additonal sealing is furnished by seals 124 and 126. These seals are respectively formed in and bolted to hub 70, and they are engaged with a cap assembly 128. The latter is bolted to the forward end of a bearing housing assembly 130.

Referring still to FIG. 2, the inner, annular support 118 of the diffuser housing assembly extends downstream from the trailing edges 134 of radial struts 114 toward combustor 32. The trailing edge of the support is bolted to bearing housing assembly 130, supporting the latter from the external turbine engine housings.

A tube 136 through one of the struts 114 and a communicating tube 138 through housing 130 supply lubricant to the tapered land bearings 96 and 98 supporting rear compressor hub 70 and shaft 68.

Air discharged from compressor 12 flows through diverging diffuser 28 and is dumped into the forward part of plenum 30 defined by inner support 118 and intermediate wall 116 of assembly 108 to provide an additonal decrease in the flow velocity of the air. Because struts 114 have an airfoil section with the leading edge 140 facing compressor 12 and because of the relatively low velocity in the forward part of the plenum chamber, the struts 114 produce substantially less disturbance in the flow pattern of the air discharged from the diffuser than conventional diffuser housed struts.

Furthermore, as the air flows through that part of plenum 30 extending from the trailing edges 134 of the struts to combustor 32 (a distance of ca. 8.75 inches in one engine employing a compressor-combustor interface embodying the principles of the present invention), such flow disturbances as may exist have an opportunity to dissipate due to the low velocity in the plenum, resulting in an even distribution of the air reaching the combustor. As indicated above, the consequence of this is minimized local overheating and increased thermal efficiency.

It was also pointed out above the plenum 30 furnishes a convenient source from which air may be bled to gas producer turbine 46 to cool the first and second stage nozzles 50 and 52 of the latter and the first stage 56 of the gas producer turbine rotor 54.

In particular, combustor 32 includes an inner, annular air liner 142 which extends adjacent combustor flame tube 144 from the inner support 118 of diffuser housing assembly 108 at its forward or upstream end to a first stage nozzle diaphragm 146 at its rear or downwstream end and defines the inner boundary of the aft or downstream part of plenum 30. Liner 142 is spaced from the cover 148 on bearing housing assembly 130, forming an annular plenum or passage 150 between the inner air liner and the cover.

Compressor discharge air is bled from plenum 30 into passage 150 through apertures 152 in the inner air liner. This bleed air flows through annular passage 150 to diaphragm 146 and then through the latter to the first stage 56 of the gas producer turbine rotor in a manner described in detail in copending application Ser. No. 831,961 filed Sept. 9, 1977.

A second annular passage 154 for compressor bleed air communicating at its upstream end with plenum 30 is formed by and between combustor case 34 and an annular, outer air liner 156 surrounding flame tube 144. Compressor discharge air flows through passage 154 to a plenum 158 between nozzle case 42 and turbine housing 44. From this plenum the air flows into the first and second stage nozzles 50 and 52 of the gas producer turbine 46 to cool the latter and impinges on the nozzle case to cool it, all as described in copending application Ser. No. 831,961.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A gas turbine engine comprising: an axial flow compressor which discharges the fluid compressed therein along a path that is concentric with the axial centerline of the engine; an annular combustor located downstream from and axially aligned with said compressor; a turbine having a rotor with at least one bladed stage, said turbine being in fluid communication with the downstream end of said combustor; and an interface between the discharge side of said compressor and the upstream end of the combustor which comprises: a diverging annular diffuser disposed immediately downstream from and in axial alginment with said compressor, said annular diffuser having an inlet communicating with the discharge side of the compressor and an outlet downstream therefrom which has a larger cross-sectional area than said inlet; an annular plenum disposed upstream from said combustor in axial alignment with said diffuser and in fluid communication with the outlet of said diffuser, said plenum having an outlet communicating with said annular combustor at the upstream end thereof and a larger cross-sectional area than said diffuser outlet whereby air dumped into said plenum through said diffuser outlet will undergo a reduction in velocity; and radially oriented struts located in said plenum, said struts having an airfoil section and the leading edges of said struts facing the discharge side of the compressor, thereby minimizing strut related disturbances in the flow pattern of the air discharged from said compressor; said plenum having a portion thereof extending from the locus of the struts to the combustor in which distrubances introduced into the air flow pattern have an opportunity to dissipate before reaching the combustor; said combustor including an annular, inner air liner defining the inner boundary of the plenum in which the struts are located; and said engine also including an annular shaft housing assembly co-axial with and spaced inwardly from said air liner to form therewith a passage communicating at its downstream end with said bladed stage of the turbine rotor, there being openings in said inner air liner through which compressor discharge air can bleed from the plenum into said passage for delivery to said bladed rotor stage to cool the latter.

2. A gas turbine engine as defined in claim 1 which includes a compressor housing and an annular combustor housing spaced downstream from said compressor housing; wherein said radially oriented struts are integrated with an annular housing into a unitary diffuser assembly; and where said annular housing of said diffuser assembly spans the distance between said compressor housing and said combustor housing.

3. A gas turbine engine as defined in claim 2 wherein the unitary diffuser assembly comprising said annular housing and said struts also includes an annular bracket at, and integrated with, the inner ends of said struts; said annular bracket of said diffuser assembly fitting around and being fixed in supporting relationship to said annular shaft housing assembly.

4. A gas turbine engine comprising: a compressor having a rotor; a combustor; an interface between the discharge side of said compressor and the upstream end of the combustor which comprises a diverging annular diffuser having an inlet communicating with the discharge side of the compressor and an outlet downstream therefrom which has a larger cross-sectional area than said inlet, an annular plenum disposed in fluid communication with the outlet of said diffuser, and radially oriented struts located in said plenum to minimize disturbances in the flow pattern of the air discharged from said compressor; said plenum having a larger cross-sectional area than said diffuser outlet whereby air dumped into said plenum through said outlet will undergo a reduction in velocity and said plenum having a portion thereof extending from the locus of the struts to the combustor in which disturbances introduced into the air flow pattern have an opportunity to dissipate before reaching the combustor; a gas producer turbine having a rotor with at least one bladed stage, said turbine being in fluid communication with the downstream end of said combustor; and means drive-connecting said gas producer turbine to said compressor rotor which comprises a shaft extending from the rotor of the gas producer turbine toward said compressor and hub means between and drive-connected at opposite ends to said compressor rotor and said shaft, said hub means having a radially extending flange at the end thereof facing said compressor; said compressor also including stators at the inlet end of said diffuser; and said diffuser also including a diffuser housing assembly at the discharge side of said compressor, said assembly comprising said radially extending struts, an annular housing which surrounds and is integral with said struts at the outer ends thereof and forms the outer boundary of the diffuser, an annular, inner bracket at and integral with the inner ends of said struts, and an annular shroud which, together with said bracket, defines the inner boundary of said diffuser, said shroud being confined at one end thereof between the flange on said hub and the stators at the discharge side of the compressor and the other end of said shroud being fixed to the inner bracket of the diffuser assembly.

* * * * *

UNITED STATES PATENT AND TRADEMARK OFFICE

CERTIFICATE OF CORRECTION

PATENT NO. : 4,167,097

DATED : September 11, 1979

INVENTOR(S) : Leon R. Wosika, et al

It is certified that error appears in the above-identified patent and that said Letters Patent are hereby corrected as shown below:

COLUMN 1, line 64, "combustion" should read --components--.

Signed and Sealed this

First Day of April 1980

[SEAL]

Attest:

SIDNEY A. DIAMOND

Attesting Officer

Commissioner of Patents and Trademarks